US008016145B2

(12) United States Patent
Perkins

(10) Patent No.: US 8,016,145 B2
(45) Date of Patent: Sep. 13, 2011

(54) COLLAPSIBLE BULK CONTAINER

(75) Inventor: David W. Perkins, Hiawatha, IA (US)

(73) Assignee: Plastic Systems, Inc., Des Moines, IA (US)

( * ) Notice: Subject to any disclaimer, the term of this patent is extended or adjusted under 35 U.S.C. 154(b) by 735 days.

(21) Appl. No.: 11/637,456

(22) Filed: Dec. 12, 2006

(65) Prior Publication Data

US 2008/0135547 A1 Jun. 12, 2008

(51) Int. Cl.
*B65D 90/04* (2006.01)
*B65D 21/032* (2006.01)

(52) U.S. Cl. ..... 220/1.6; 206/509

(58) Field of Classification Search ..... 220/1.6, 220/1.5, 4.33, 4.28, 9.2, 9.1, 9.4, 495.06, 220/23.86, 23.83, 23.6, 495.01, 4.01, 23.2, 220/FOR. 115, FOR. 113, FOR. 112, FOR. 122, 220/FOR. 12; 206/512, 511, 509, 508, 504, 206/600, 503, 386; 383/119; D9/432, 430, D9/414; 217/3 R, 5, 43 R, 45, 36, 13, 12 R; *B65D 90/04, 88/00, 21/032, 21/02, 25/14*
See application file for complete search history.

(56) References Cited

U.S. PATENT DOCUMENTS

| | | | | |
|---|---|---|---|---|
| 186,459 | A | | 1/1877 | Buckingham |
| 371,159 | A | | 10/1887 | Wright, Jr. |
| 648,385 | A | | 5/1900 | Burns |
| 942,733 | A | | 12/1909 | Moses |
| 1,585,390 | A | | 5/1926 | Kondolf |
| 1,926,432 | A | * | 9/1933 | Butts et al. ..... 294/68.21 |
| 2,147,563 | A | | 2/1939 | Turner |
| 2,345,000 | A | | 3/1944 | Kitchener |
| 2,382,536 | A | * | 8/1945 | Baxter ..... 229/117.35 |
| 2,422,239 | A | * | 6/1947 | Holt ..... 220/560.02 |
| 2,522,597 | A | | 9/1950 | Blandford |
| 2,565,053 | A | | 8/1951 | Stenger |
| 2,617,579 | A | | 11/1952 | Buttery |
| 2,799,440 | A | | 7/1957 | Frederich |
| 2,869,750 | A | * | 1/1959 | Doerr et al. ..... 220/4.28 |
| 2,887,264 | A | | 5/1959 | Fallert |
| 3,045,387 | A | | 7/1962 | Simpson |
| 3,303,965 | A | * | 2/1967 | Parker et al. ..... 206/511 |
| 3,374,915 | A | * | 3/1968 | Verhein et al. ..... 220/4.28 |
| 3,401,814 | A | * | 9/1968 | Chiswell et al. ..... 220/4.33 |

(Continued)

FOREIGN PATENT DOCUMENTS

EP 589483 A1 3/1993

(Continued)

OTHER PUBLICATIONS

US 6,675,964, 9/2001, Beck (withdrawn).

*Primary Examiner* — Mickey Yu
*Assistant Examiner* — Robert J Hicks
(74) *Attorney, Agent, or Firm* — Brett Trout

(57) ABSTRACT

A stackable collapsible container for flowable materials. The container has a flexible outer skin and rigid support, having a top frame and bottom frame connected by poles. The top frame and bottom frame are designed for mating engagement when the containers are stacked, as well as for mating engagement when the containers are broken down for transport. The top frame and bottom frame are provided with similar perimeters to prevent undesired movement and contact between adjacent top frame when the containers are filled and transported.

17 Claims, 5 Drawing Sheets

U.S. PATENT DOCUMENTS 3,489,314 A * 1/1970 Slapnik ..... 206/504
3,521,764 A 7/1970 Loomis
3,701,466 A 10/1972 Woodrow et al.
3,762,343 A 10/1973 Thacker
3,932,946 A * 1/1976 Johnson ..... 34/201
4,014,496 A 3/1977 Christensson
4,036,361 A 7/1977 Jacobson et al.
4,082,215 A 4/1978 Eichenauer
4,186,841 A * 2/1980 Buckley et al. ..... 220/6
4,216,897 A 8/1980 Collura et al.
4,266,670 A 5/1981 Mykleby
4,266,678 A * 5/1981 Daly ..... 211/194
4,287,997 A * 9/1981 Rolfe et al. ..... 220/1.5
4,339,047 A 7/1982 Johansson et al.
4,359,182 A 11/1982 Perkins, Jr.
4,421,253 A 12/1983 Croley
4,591,065 A * 5/1986 Foy ..... 220/7
4,673,087 A * 6/1987 Webb ..... 206/600
4,742,951 A * 5/1988 Kelly et al. ..... 229/109
4,771,917 A * 9/1988 Heaps et al. ..... 222/92
4,804,087 A 2/1989 Smith
4,809,851 A * 3/1989 Oestreich et al. ..... 206/599
RE33,128 E 12/1989 Nordstrom
4,934,636 A * 6/1990 Orlosky et al. ..... 248/95
5,025,925 A 6/1991 Wiklund
5,056,667 A * 10/1991 Coogan ..... 206/600
5,069,359 A * 12/1991 Liebel ..... 229/117.3
5,123,541 A * 6/1992 Giannini et al. ..... 206/600
5,269,455 A 12/1993 Grigsby et al.
5,289,937 A * 3/1994 Boots ..... 220/9.1
5,351,847 A * 10/1994 Greenbaum ..... 220/9.1
5,353,982 A * 10/1994 Perkins et al. ..... 229/117.3
5,402,906 A 4/1995 Brown et al.
5,437,384 A * 8/1995 Farrell ..... 220/1.5
5,501,333 A * 3/1996 Swan ..... 206/386
5,722,552 A 3/1998 Olson
5,746,343 A 5/1998 Waltke et al.
5,749,489 A 5/1998 Benner et al.
5,803,346 A 9/1998 Baker et al.
6,000,549 A * 12/1999 Perkins ..... 206/596
6,113,270 A 9/2000 Hafer
6,161,715 A * 12/2000 Stolzman ..... 220/1.5
6,170,689 B1 1/2001 Flesher et al.
6,516,965 B1 * 2/2003 Perkins ..... 220/9.4
6,631,821 B2 * 10/2003 Vourganas ..... 220/1.5
2003/0132275 A1 7/2003 Ingalls
2004/0238400 A1 * 12/2004 Knutsson et al. ..... 206/600
2005/0045639 A1 * 3/2005 Thorpe ..... 220/495.01

FOREIGN PATENT DOCUMENTS

EP 0573230 A1 5/1993
EP 703158 A1 9/1994
GB 2084540 A 9/1980

* cited by examiner

COLLAPSIBLE BULK CONTAINER

BACKGROUND OF THE INVENTION

1. Field of the Invention

The present invention relates to a bulk container for flowable materials and, more specifically, to a flexible bulk container system which is stackable both in use and in storage, and is collapsible to facilitate more compact storage and transportation.

2. Description of the Prior Art

It is known in the art to provide rigid containers, such as drums, for the storage and transportation of flowable materials. Such prior art drums, however, are bulky and heavy, even when not in use. Also, by utilizing the strength attributes of a circular exterior, such drums do not maximize space most efficiently. Accordingly, when such drums are placed on a pallet, there are substantial open interior spaces, which could be better utilized to store flowable materials.

It is also known in the art to reduce weight by providing a container of a flexible, circular construction, which may be collapsed for transportation and storage after use. While such containers utilize space somewhat more efficiently than drums, are somewhat lighter than drums, and may be reduced in size for storage, such containers do not maximize the available space for storage of flowable materials. Additionally, since such containers do not possess rigid sides, they cannot be stacked, thereby substantially reducing their ability to maximize utilization of warehouse space.

While it is known in the art to provide rigid, square containers, maximizing the space allocation and allowing for the containers to be stacked, such containers are typically heavy, expensive, and difficult to collapse for storage or transportation when not in use.

It is also known in the art to provide collapsible containers with rigid side supports to allow for the containers to be stacked. One drawback associated with this construction is that such containers typically require strapping material or other securement mechanisms to be provided across the top of the container, thereby reducing access to the top of the container and preventing the container from being used in association with many flowable material filling systems. Also, such containers are typically of a cylindrical construction, thereby preventing them from utilizing space most efficiently.

It is further known in the art to provide stackable collapsible containers which have a top and bottom panel for receiving tubular supports which extend therebetween. The tubular supports are typically provided with cross bracing which adds strength, but which also adds cost, weight, complexity and difficulty in assembly, disassembly and storing the container. When it is desired to transport the stackable collapsible container in the collapsed orientation, the tubular supports and top panel are provided within the bottom panel. As the top panel is required to be of dimensions sufficient to fit inside the perimeter of the bottom panel, the top panel is necessarily smaller than the bottom panel. When the containers are stacked near one another for transport, with the bottom panels in contact with one another, the top panels of adjacent containers necessarily have a space therebetween. This space, although small, prevents such prior art containers from obtaining lateral support from the top panel of an adjacent container. The filled containers are typically being transported in a rail car or the like. When the rail car stops or starts suddenly, the space between the top panels of the containers allows the containers to generate momentum, causing the top panels of the containers to sway into and out of contact with one another. These undesired torsional forces lead to damage and possible failure of the container.

Accordingly, it is desirable to provide a container for flowable materials which is of a low cost, lightweight construction, easily collapsible for storage and transportation when not in use. It is also desirable to provide a container for flowable materials which provides a large access area into the container from the top of the container, which is stackable both when in use and when not in use, and when in use provides improved lateral support characteristics both at the bottom and top of the flowable materials container when the container is filled with flowable material. The difficulties encountered in the prior art heretofore are substantially eliminated by the present invention.

SUMMARY OF THE INVENTION

The present invention relates to a bulk container having a first frame and a second frame which receive supports therebetween. A flexible outer bag and a flexible inner bag are provided between the frames. Means are provided on the first frame for receiving the second frame and for retaining the second frame against lateral movement relative to the first frame. The receiving means align the sides of the first frame substantially planar with the sides of the second frame. In the preferred embodiment, the second frame interlocks into the first frame, securing the second frame against lateral movement relative to the first frame during transport. This allows the second frame to be of dimensions similar to the first frame. When the container is filled with flowable material, both the first frame and second frame of adjacent containers provide lateral support to one another.

It is an object of the present invention to provide a flowable materials container which is low cost.

It is another object of the present invention to provide a flowable materials container which is lightweight.

It is still another object of the present invention to provide a flowable materials container which may be stacked upon it when filled.

It is yet another object of the present invention to provide a flowable materials container which efficiently utilizes available storage space efficiently.

It is yet another object of the present invention to provide a flowable materials container which may be used in association with standard pallets.

It is yet another object of the present invention to provide a flowable materials container which when stacked near a similarly filled flowable materials container, the bottom panels thereof and top panels thereof provide lateral support to one another.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
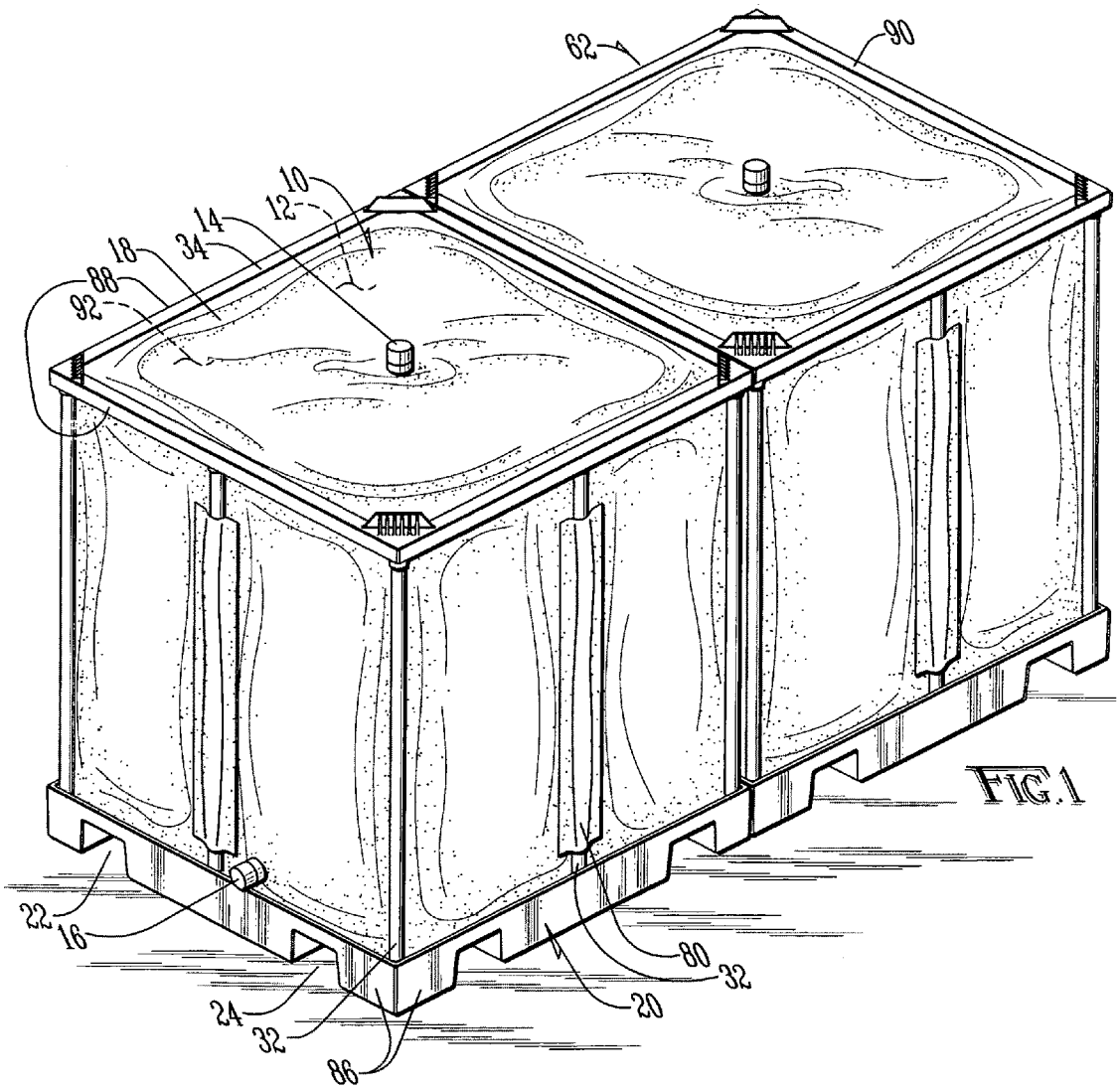
FIG. 1 illustrates a perspective view of a pair of containers of the present invention stacked adjacent to one another.

A stackable collapsible container for flowable materials is shown generally as (10) in FIG. 1. The container (10) includes a removable flexible inner liner (12) having an inlet opening with a top cap (14) and a drain or outlet opening with a threaded plug (16). Preferably, the removable flexible inner liner (12) is constructed of polyethylene, such as that well known in the art to hold non-hazardous fluid material. The container (10) includes an outer liner (18). Preferably, the outer liner (18) is constructed of a woven polypropylene material. The outer liner (18), however, can be constructed of any lightweight material well known in the art to have strength characteristics sufficient to contain a flowable material. The outer liner (18) is preferably waterproof, or coated with a waterproof material in a manner such as that known in the art to allow the container (10) to be used outdoors as well as indoors.

Figure 2:
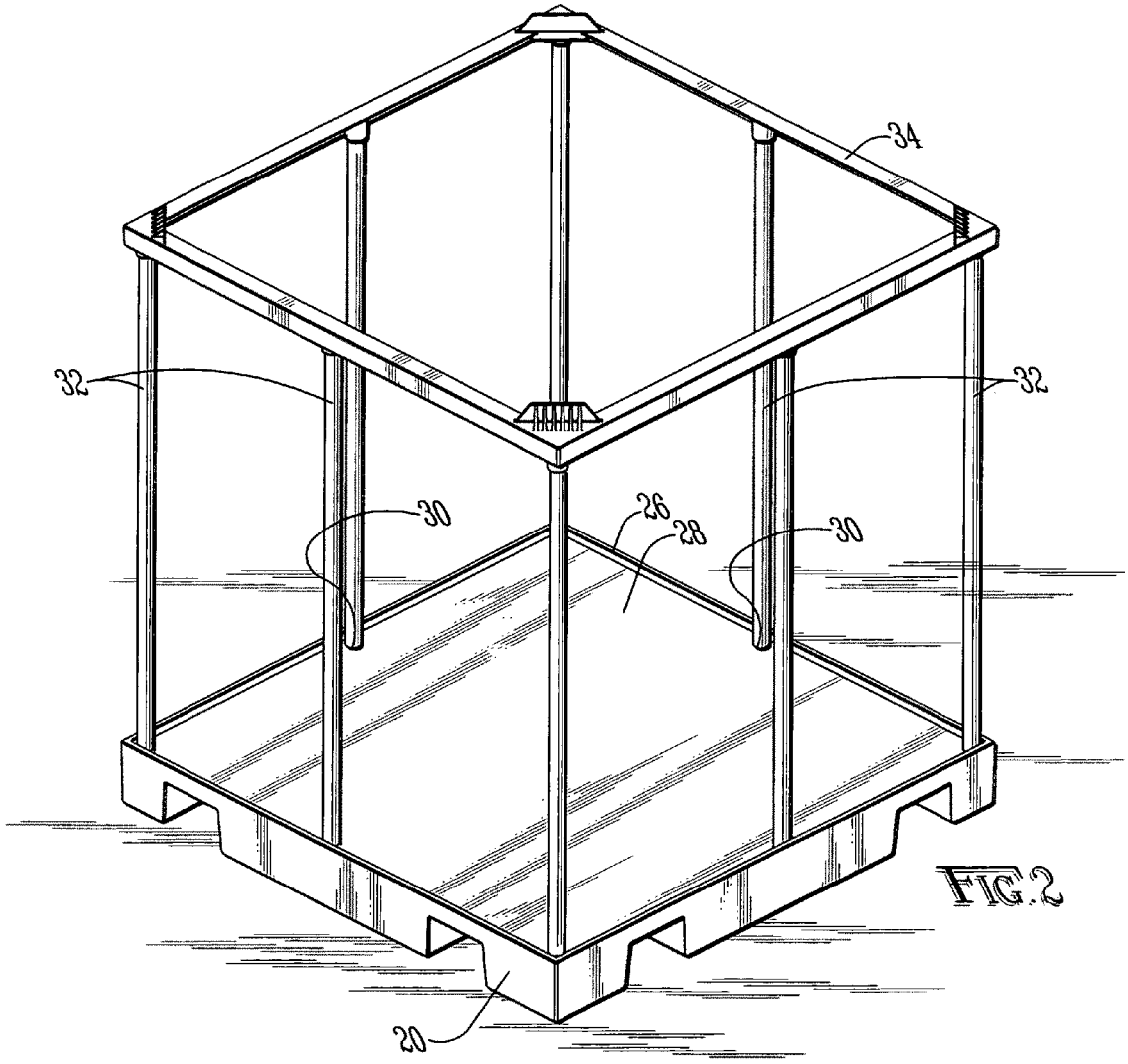
FIG. 2 illustrates a side perspective view of the top panel, bottom panel and supports of the container of the present invention.

As shown in FIG. 1, the container (10) is provided with a first frame (20), preferably rotationally molded of a strong weather-resistant plastic. As shown, the first frame (20) is provided with fork holes (22) and (24) to allow a forklift (not shown) to easily engage and lift the first frame (20). As shown in FIG. 2, the first frame (20) is provided with a raised lip (26) defining a recessed platform (28). Although the lip (26) may be of any suitable dimensions, in the preferred embodiment, the lip (26) is 2.5 centimeters in height and 1.0 centimeter in width.

Figure 3:
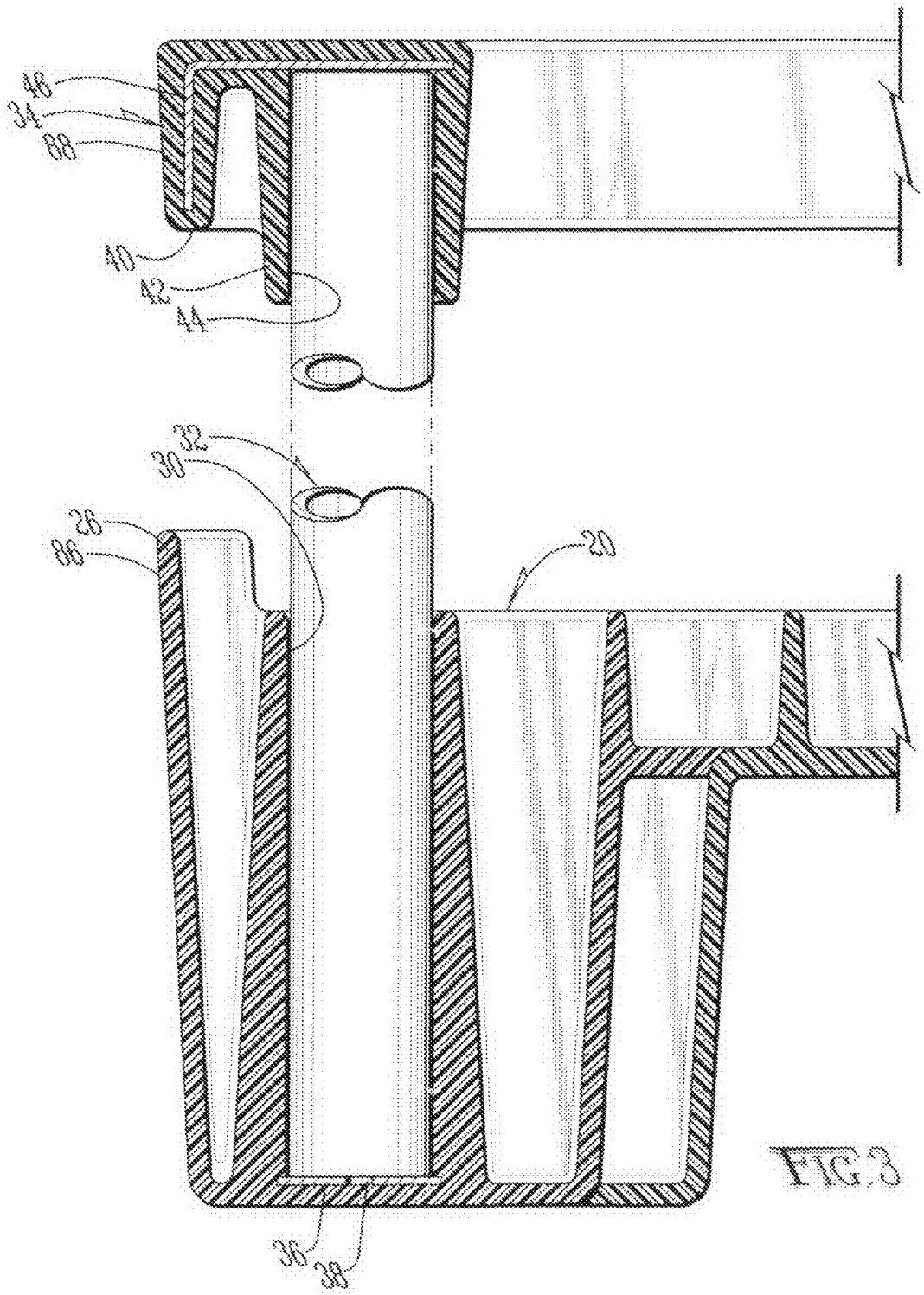
FIG. 3 illustrates a side elevation in cross section of the top frame matingly aligned with the bottom frame.

As shown in FIGS. 2 and 3, the first frame (20) is provided with a plurality of pole sockets (30). While the pole sockets (30) may be of any suitable width or dimension, the pole sockets (30) are preferably of a diameter and depth suitable to retain poles (32) against undesired deflection, without the need for additional cross-bracing such as wires or braces provided between the poles (32). As shown in FIG. 3, the first frame (20) is provided with a plurality of molded-in metal braces (36) having a diameter greater than the diameter of the pole sockets (30).

As shown in FIG. 3, while the braces (36) are preferably provided with a center hole (38) and a diameter greater than the diameter of the pole sockets (30), if desired, the braces (36) may be solid, without a center hole (38), and may have a diameter slightly smaller than the diameter of the pole sockets (30). In this embodiment, the braces (36) may be secured to the first frame (20) by adhesive or similar securement means known in the art.

As shown in FIG. 3, the second frame (34) is provided with a shoulder (40) which is 1.0 centimeter wide and 2.5 centimeters deep. The shoulder (40) defines one side of an inner rib (42) which is 2.5 centimeters deep and 5.0 centimeters wide. Provided in the inner rib (42) are eight pole sockets (44), deep enough to maintain the poles (32) against undesired movement relative to the second frame (34). While the pole sockets (30) may be of any suitable dimensions, in the preferred embodiment, the pole sockets (30) are 10.0 centimeters deep and the pole sockets (44) are 5.0 centimeters deep.

Figure 4:
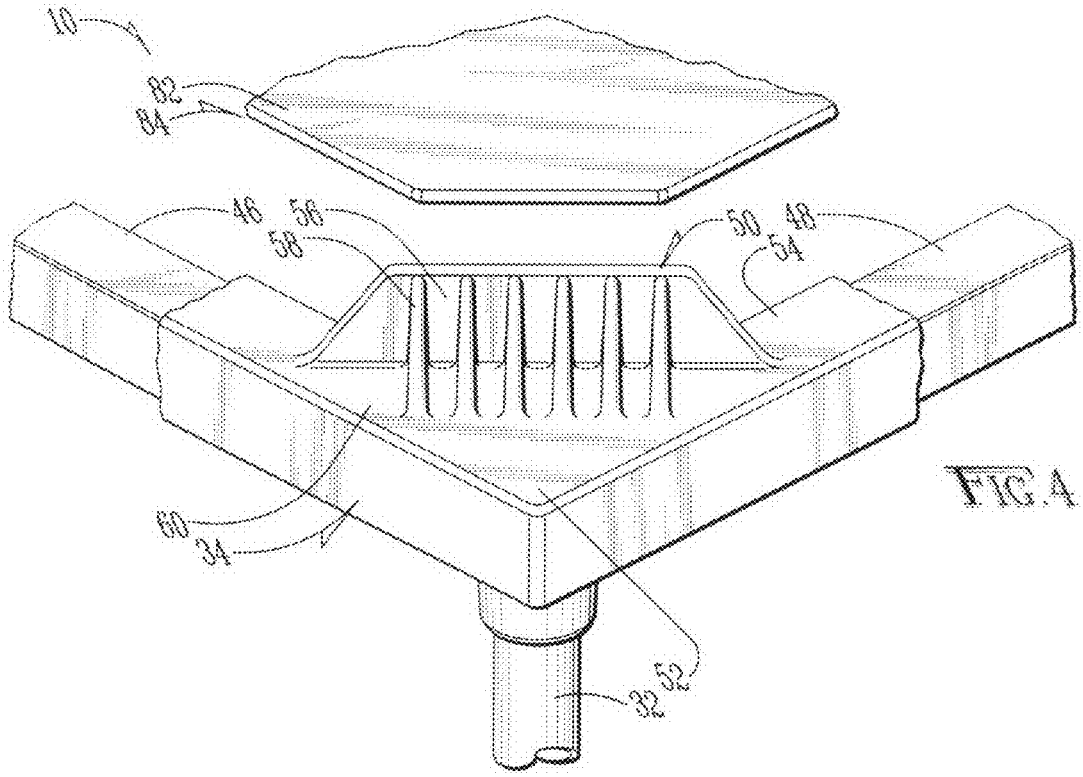
FIG. 4 illustrates a top perspective view in cutaway and phantom, showing the interior support skeleton of the top frame.

As shown in FIGS. 3 and 4, molded into the second frame (34) are a plurality of steel braces (46) and (48). The steel braces (46) and (48) are molded into the second frame (34) above the pole sockets (44) to allow the poles (32) to contact the steel braces (46) and (48) to prevent the poles (32) from pushing through the second frame (34). As shown in FIG. 4, the steel braces (46) are slightly longer than the steel braces (48) to allow the steel braces (46) to accommodate the poles (32) positioned at the corners of the container (10). Alternatively, a single square steel brace (not shown), or steel braces of a similar length (not shown) may be utilized and spaced so each brace accommodates a single one of the poles (32) positioned at each corner of the container (10). As shown in FIG. 3, the first frame (20) is provided with a perimeter (86) similar in length to the perimeter (88) of the second frame (34). When the second frame (34) is positioned into mating engagement with the first frame (20), the perimeters (86) and (88) are parallel with one another.

Figure 5:
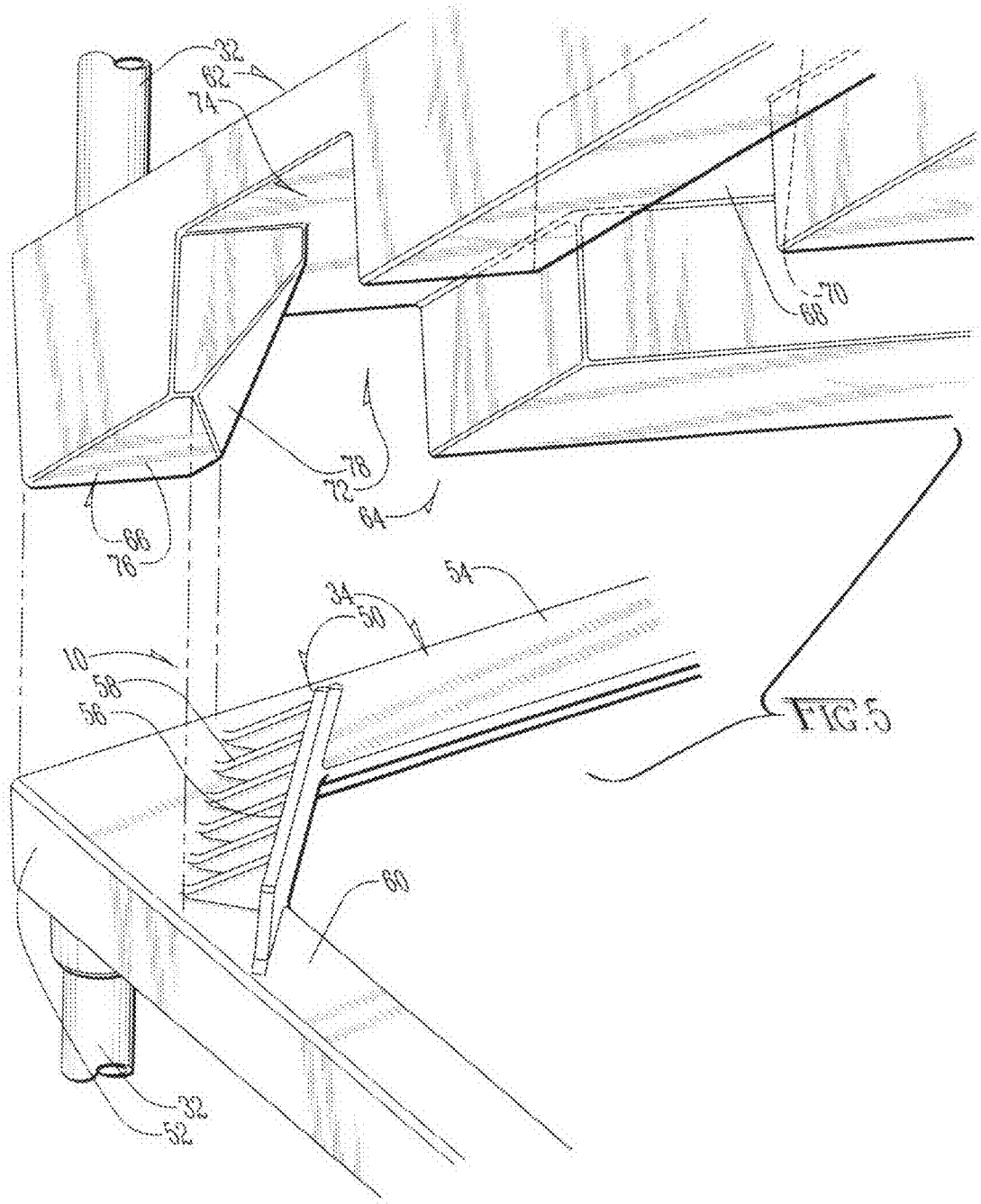
FIG. 5 illustrates a side perspective view of the bottom frame of one container matingly aligned with the top frame of another container.

As shown in FIG. 4, the second frame (34) is molded of a resilient plastic material such as those known in the art. To further strengthen the second frame (34), locator pins (50) span each corner (52) of the sides (54) of the second frame (34). As shown in FIGS. 4 and 5, each locator pin (50) is provided with a front face (56) which extends above the top (60) of the second frame (34). The front face (56) is supported by a plurality of ribs (58), but may be supported by a solid block of material tapering downward from the front face (56) to the top (60) of the second frame (34).

In addition to strengthening the second frame (34) and adding rigidity thereto, the locater pins (50) also assist in locating containers (10) and (62) relative to one another when one container (62) is stacked on top of another container (10). As shown in FIG. 5, the bottom (64) of the first frame (66) of the other container (62) is provided with crossing fork slots (68) in communication with fork holes (72) and (74). The fork slots (68) and (70), and fork holes (72) and (74), define feet (76) at each corner of the bottom (64) of the first frame (66) of the container (62). As shown in FIG. 5, the feet (76) are each provided with a chamfered face (78) of an angle sufficient to fit into mating engagement with the ribs (58) of the locator pins (50). When the container (62) is stacked on top of the container (10), even if the container (62) and (10) are not precisely oriented, the ribs (58) of the locator pins (50) engage the chamfered faces (78) of the feet (76), guiding the first frame (66) of the container (62) into precise mating engagement with the locator pins (50) of the second frame (34).

When it is desired to use the container (10) of the present invention, the poles (32) are positioned within the pole sockets (30) of the first frame (20). The outer liner (18) is secured to the poles (32) either by weaving the outer liner (18) around the poles (32) or, in the preferred embodiment, by providing the outer linter (18) with sleeves (80) through which one or more of the poles (32) are provided. Securing some or all of the poles (32) through the sleeves (80) prevents the outer liner (18) from moving relative to the poles (32). Alternatively, the outer liner (18) may be secured to the second frame (34) and/or first frame (20) in any manner such as that known in the art. The second frame (34) is positioned so the poles (32) enter the pole sockets (44) of the second frame (34).

The inner liner (12) is then provided within the outer liner (18) and the top cap (14) is opened to allow the inner liner (12) to be filled with flowable material (92) by any means known in the art. Once the inner liner (12) has been filled, the top cap (14) is secured. A dust cover (82) may then be positioned over the inner liner (12) as shown in FIG. 4 to protect the top of the inner liner (12) and top cap (14) from dust and damage. The dust cover (82) may be constructed of any suitable material. In the preferred embodiment, the dust cover (82) is preferably constructed of a thin, but rigid, sheet of plastic provided with chamfered corners (84) to accommodate the locator pins (50).

As shown in FIG. 1, during transport, the container (10) may be secured adjacent to the container (62). One advantage of the present invention over the prior art is the similarity in size of the outer perimeter (86) of the first frame (20) and the outer perimeter (88) of the second frame (34). As shown in FIG. 1, by providing the container (10) with identical perimeter lengths of both the first frame (20) and second frame (34), when the containers (10) and (62) are positioned adjacent one another, there is little to no "play" between the second frame (34) of the container (10) and second frame (90) of the container (62). In prior art devices, the second frame is often provided with a smaller perimeter than the first frame, to allow the second frame to be completely contained within the perimeter of the first frame for storage and transport when the container is not filled. Unfortunately, prior art use of a smaller perimeter second frame prevents the second frame from contacting an adjacent second frame when the first frames are adjacent. The space provided between the second frames in prior art devices allows for a significant amount of "play" between the containers. In situations where the containers are being transported, the second frame may slam into and out of contact with an adjacent second frame during changes in direction, acceleration and deceleration. In severe instances, the contact may transfer across several adjacent containers, building in force to a point sufficient to cause damage to the containers, the transport vehicle, nearby persons or the flowable material (92). By providing the second frames (34) and (90) adjacent one another, this undesired movement and damage can be significantly reduced.

Once the containers (10) and (62) reach their destination, the flowable material (92) provided within the containers (10) and (62) may be drained utilizing the threaded plug (16). Once the containers (10) and (62) have been drained, the inner liner (12) may be discarded. When it is desired to transport the containers (10) and (62) after they have been emptied, the second frame (34) may be removed from the poles (32) and the poles (32) disengaged from the first frame (20). The outer liner (18) may be folded and placed on the platform (28) along with the poles (32). As shown in FIG. 3, the second frame (90) is thereafter positioned onto the first frame (20), with the lip (26) engaging the shoulder (40) in mating engagement. As shown, the inner rib (42) is of a sufficient height to define an interstice (94) sufficient to accommodate the poles (32) and outer liner (18).

The foregoing description and drawings merely explain and illustrate the invention, and the invention is not limited thereto, except insofar as the claims are so limited, as those skilled in the art that have the disclosure before them will be able to make modifications and variations therein without departing from the scope of the invention.

What is claimed is:

1. A bulk container comprising:

(a) a first frame comprising:
  (i) a shoulder defining the exterior perimeter of the first frame; and
  (ii) a surface recessed laterally inward and vertically downward from the shoulder, wherein the surface defines a first plurality of slots;

(b) a second frame comprising:
  (i) a recessed outer lip defining the exterior perimeter of the second frame; and
  (ii) an inner flange depending below the outer lip wherein the inner flange defines a second plurality of slots;

(c) wherein the second frame is configured to fit into mating engagement with the first frame, with the inner flange extending past at least a portion of the shoulder and the recessed outer lip cantilevered with respect to the second frame and the recessed outer lip is positioned over the shoulder;

(d) a plurality of supports secured within the first plurality of slots and the second plurality of slots;

(e) a flexible outer liner secured between the first frame and the second frame; and (f) a flexible inner liner provided within the outer liner.

2. The bulk container of claim 1, further comprising a locator pin provided on the second frame and a chamfered face provided on the first frame and configured to fit into mating engagement with the locator pin.

3. The bulk container of claim 2, wherein the second frame comprises a first arm, a second arm, a third arm and a fourth arm, a first corner, a second corner, a third corner and a fourth corner.

4. The bulk container of claim 3, wherein the locator pin extends from the first arm to the second arm across the first corner.

5. A bulk container comprising:

(a) a first support;

(b) a second support;

(c) a first frame comprising:
  (i) a top defining a first slot and a second slot;
  (ii) an extended outer flange defining a recessed interior; and
  (iii) wherein the first slot and the second slot are surrounded by the extended outer flange;

(d) a second frame comprising:
  (i) a bottom defining a third slot and a fourth slot;
  (ii) a recessed outer lip;
  (iii) a depending inner flange; and
  (iv) wherein the third slot and the fourth slot are surrounded by the recessed outer lip;

(e) wherein the first support is provided within the first slot and the third slot;

(f) wherein the second support is provided within the second slot and the fourth slot;

(g) wherein the recessed outer flange of the first frame is provided with an exterior perimeter greater than the interior perimeter of the recessed interior of the second frame;

(h) a flexible outer liner secured between the first frame and the second frame; and (i) a flexible inner liner provided within the outer liner and defining an interior of at least four hundred liters.

6. The bulk container of claim 5, further comprising a locator pin provided on the second frame and a chamfered face provided on the first frame and configured to fit into mating engagement with the locator pin.

7. The bulk container of claim 6, wherein the second frame comprises a first arm, a second arm, a third arm and a fourth arm, a first corner, a second corner, a third corner and a fourth corner.

8. The bulk container of claim 7, wherein the locator pin extends from the first arm to the second arm across the first corner.

9. The bulk container of claim 5, wherein the extended outer flange is provided with an interior perimeter greater than the exterior perimeter of the depending inner flange.

10. The bulk container of claim 5, further comprising a first brace positioned between the first support and the first frame, and a second brace positioned between the first support and the second frame.

11. The bulk container of claim 5, wherein the depending inner flange fits into mating engagement with the recessed interior.

12. The bulk container of claim 11, further comprising a locator pin provided on the second frame and a chamfered face provided on the first frame and configured to fit into mating engagement with the locator pin.

13. A bulk container comprising:

(a) a first frame comprising:

(i) an extended outer flange defining a recessed interior;

(ii) wherein the recessed interior defines a first slot, a second slot, a third slot and a fourth slot; and (iii) wherein the first slot, the second slot, the third slot and the fourth slot are surrounded by the extended outer flange;

(b) a second frame comprising:

(i) a recessed outer lip;

(ii) a depending inner flange;

(iii) a surface defining a fifth slot, a sixth slot, a seventh slot and an eighth slot;

(iv) wherein the fifth slot, the sixth slot, the seventh slot and the eighth slot are surrounded by the recessed outer lip;

(c) wherein the second frame is configured to fit into mating engagement with the first frame, with the inner flange extending past at least a portion of the shoulder, and the recessed outer lip cantilevered with respect to the second frame and the recessed outer lip is positioned over the outer flange;

(d) wherein the recessed outer flange of the first frame is provided with an exterior perimeter greater than the interior perimeter of the recessed interior of the second frame;

(e) a first support having a first end received within the first slot and a second end received within the fifth slot;

(f) a second support having a first end received within the second slot and a second end received within the sixth slot;

(g) a third support having a first end received within the third slot and a second end received within the seventh slot;

(h) a fourth support having a first end received within the fourth slot and a second end received within the eighth slot;

(i) a flexible outer liner secured between the first frame and the second frame; and (j) a flexible inner liner provided within the outer liner and defining an interior of at least four hundred liters.

14. The bulk container of claim 13, further comprising a locator pin provided on the second frame and a chamfered face provided on the first frame and configured to fit into mating engagement with the locator pin.

15. The bulk container of claim 14, wherein the second frame comprises a first arm, a second arm, a third arm and a fourth arm, a first corner, a second corner, a third corner and a fourth corner.

16. The bulk container of claim 15, wherein the locator pin extends from the first arm to the second arm across the first corner.

17. The bulk container of claim 13, further comprising a first brace positioned between the first support and the first frame, and a second brace positioned between the first support and the second frame.

* * * * *